United States Patent [19]

Young et al.

[11] Patent Number: 5,067,657

[45] Date of Patent: Nov. 26, 1991

[54] BURNER NOZZLE

[75] Inventors: Timothy M. Young, Copplee; Charles D. Coppedge, Euless; Charles S. McCasland, Westminister; Joseph L. Pearce, Jr., Dallas, all of Tex.

[73] Assignee: Halliburton Company, Duncan, Del.

[21] Appl. No.: 431,050

[22] Filed: Nov. 1, 1989

[51] Int. Cl.[5] ..... B05B 7/10

[52] U.S. Cl. ..... 239/403; 239/490; 239/497; 239/600; 239/397.5

[58] Field of Search ..... 239/110, 390, 347.5, 239/403, 488, 490, 492, 497, 600, 589

[56] References Cited

U.S. PATENT DOCUMENTS

| | | | |
|---|---|---|---|
| 985,505 | 2/1911 | Brinkm | 239/497 |
| 1,530,510 | 3/1925 | Morse | 239/403 |
| 1,757,023 | 5/1930 | Smith | 239/497 |
| 1,860,347 | 5/1932 | Crowe | 239/403 |
| 2,179,139 | 11/1939 | Strosk | 239/497 |
| 2,325,495 | 7/1943 | Ferguson | 239/403 |
| 2,347,149 | 4/1944 | Chirgwin | 239/589 |
| 2,482,260 | 9/1949 | Goddard | 239/418 |
| 2,636,778 | 4/1953 | Michelsen | 239/403 |
| 3,026,048 | 3/1962 | Gascoigne et al. | 239/488 |
| 3,164,200 | 1/1965 | Reed | 431/284 |
| 3,228,612 | 1/1966 | Graham et al. | 239/132.3 |
| 3,394,888 | 7/1968 | Dasse et al. | 239/424 |
| 3,460,911 | 8/1969 | Krejci et al. | 422/156 |
| 3,578,246 | 5/1971 | Davis, Sr. | 239/403 |
| 3,827,632 | 8/1974 | Rymarchyk et al. | 239/132.3 |
| 4,011,995 | 3/1977 | Krause, Jr. | 239/404 |
| 4,427,367 | 1/1984 | Yagisawa | 431/354 |
| 4,664,619 | 5/1987 | Johnson et al. | 431/154 |

FOREIGN PATENT DOCUMENTS

| | | | |
|---|---|---|---|
| 354618 | 7/1961 | Switzerland | 239/497 |
| 21066 | of 1906 | United Kingdom | 239/490 |

OTHER PUBLICATIONS

Gas Turbine Combustion, pp. 413–431.

*Primary Examiner*—Andres Kashnikow
*Assistant Examiner*—Karen B. Merritt
*Attorney, Agent, or Firm*—C. Dean Dominque; Neal R. Kennedy

[57] ABSTRACT

A burner nozzle for burning petroleum products. The burner nozzle includes a tube portion with a burner nozzle insert disposed therein. A nut is threadingly engaged with the tube portion to hold the insert in place. The insert has a substantially conical nozzle portion with an inlet portion extending substantially perpendicular to a longitudinal axis of the nozzle portion. The inlet portion defines a plurality of inlet ports therethrough. The inlet ports are angled with respect to the longitudinal axis and have an outlet end adjacent to an inner surface of the nozzle portion.

5 Claims, 1 Drawing Sheet

BURNER NOZZLE

BACKGROUND OF THE INVENTION

1. Field Of The Invention

This invention relates to burner nozzles for burning petroleum products during well testing, and more particularly, to a burner nozzle having a substantially conical tip and fluid inlet ports disposed at an acute angle with respect to a central longitudinal axis of the insert.

2. Description Of The Prior Art

Burner nozzles in which petroleum products are burned, and in particular, those used to dispose of products of oil well testing, are well known. U.S. Pat. No. 4,011,995 to Krause discloses a nozzle with petroleum products and air mixed by the nozzle to facilitate burning of the petroleum products. U.S. Pat. No. 4,664,619 to Johnson et al. discloses a burner nozzle for mixing petroleum products to be burned with air in which air is injected from an air jacket or can into a petroleum stream, exiting an oil orifice. The air jacket is spaced from the oil orifice and its petroleum product supply line such that any leakage of petroleum is directed into a space between the supply line and the air jacket so that the petroleum products cannot be forced under pressure into the air jacket. This burner nozzle utilizes an oil swirl chamber with the oil orifice integral therewith and which is attached to an oil conduit such as by welding. A plurality of air exit holes are defined in a spacer at an end of the air jacket adjacent to the oil surface. The air exit holes direct air from an annulus in the air jacket into the oil stream. These air jets serve to atomize the oil stream to facilitate burning.

In copending U.S. patent application Ser. No. 07/350,105, an air jet is disclosed which defines an annular air orifice therein to provide an even stream of air around the circumference of the petroleum stream to insure better atomization and more efficient burning.

Also in the apparatus of our prior application, a swirl chamber is provided with inlet ports or entrance orifices which are substantially perpendicular to the central longitudinal axis of the swirl chamber and the nozzle, and the ports are offset from the center line. This arrangement of ports is relatively conventional. In a swirl chamber having four ports, this geometry creates a swirl which produces a substantially conical fluid pattern as the fluid is discharged from the nozzle. The orientation of the ports is such that each jets into the one adjacent to it, and the fluid stream splits. One side of the split fluid stream continues through the swirl chamber, and the other side is directed to the rear wall or back plate of the swirl chamber where severe erosion can occur.

The present invention solves this erosion problem by providing a replaceable insert with a swirl chamber portion in which the inlet port or entrance orifices are disposed at an acute angle with respect to the longitudinal axis. This provides a gradual entrance directed forward which reduces erosion in the rear wall or back plate of the swirl chamber and also reduces erosion in the conical nozzle portion of the insert as well. This new design also has the advantage of allowing foreign matter and other debris to pass through the ports more easily than previous designs.

SUMMARY OF THE INVENTION

The burner nozzle of the present invention is adapted for use in burning petroleum products such as performed in well testing. The burner nozzle comprises a fluid conduit means for connecting to a fluid source and discharging fluid from the nozzle for burning, and further comprises an air jetting means for jetting an air stream into the discharged petroleum for agitation and atomization thereof to facilitate the burning.

In one preferred embodiment, the burner nozzle comprises a tube portion defining a central opening therein and connectable to a fluid source, a burner nozzle insert disposed in the central opening of the tube portion, fastening means for holding the insert in place, and sealing means for sealing between the insert and the tube portion. The fastening means is preferably characterized by a nut threadingly engaged with the tube portion and disposed radially outwardly of the insert. An annular gap is preferably defined between the nut and at least a portion of the insert to prevent thermal ratcheting.

One preferred embodiment of the burner nozzle insert comprises a nozzle portion having a longitudinal axis and an inlet portion adjacent to the nozzle portion wherein the inlet portion defines a plurality of ports therethrough. The ports are preferably disposed at an acute angle with respect to the longitudinal axis and angle inwardly from the inlet portion toward the nozzle portion. Each of the ports has an inlet end spaced radially outwardly from a center line of the inlet portion and an outlet end adjacent to an inner surface of the nozzle portion.

The burner nozzle insert may also be said to comprise a nozzle portion having a substantially conical configuration adjacent to an outlet end thereof and defining a longitudinal axis and an inlet portion adjacent to the nozzle portion and opposite the outlet end. The inlet portion comprises a wall substantially perpendicular to the longitudinal axis and defines the inlet ports therethrough.

The sealing means preferably comprises both a metal-to-metal seal and elastomeric sealing means between the insert and the tube portion.

An important object of the invention is to provide a burner nozzle for petroleum products which has an insert with inlet ports disposed at an angle to a longitudinal axis of the insert to provide a gradual entrance of fluid therein and minimize erosion.

Another object of the invention is to provide an integrated swirl chamber and nozzle for a petroleum burner.

An additional object of the invention is to provide a burner nozzle which has a replaceable insert and provides both metal-to-metal and elastomeric sealing between the insert and an oil tube portion of the nozzle.

Still another object of the invention is to provide a replaceable insert for a burner nozzle which is held in place by a nut radially spaced from the insert to prevent thermal ratcheting.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
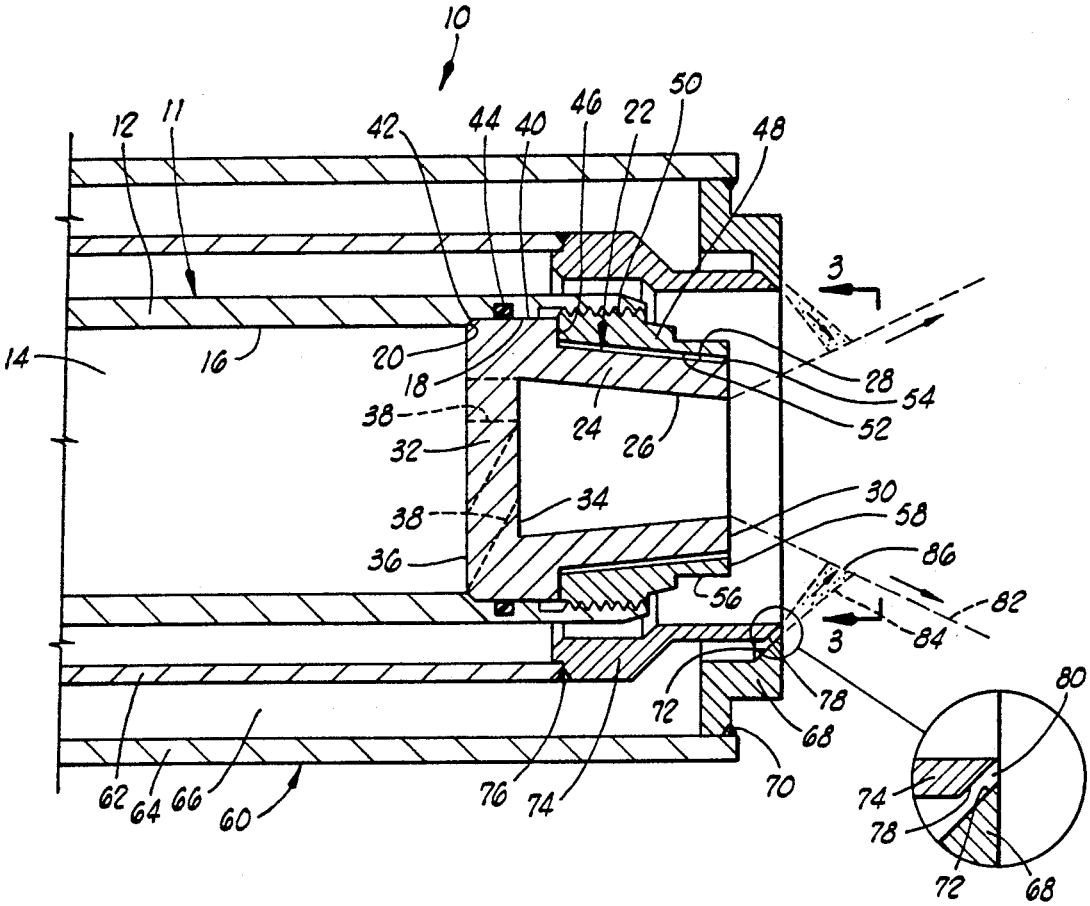
FIG. 1 is a partial longitudinal cross-sectional view of the burner nozzle of the present invention.

Referring now to the drawings, and more particularly to FIG. 1, the burner nozzle of the present invention is shown and generally designated by the numeral 10. As will be further discussed herein, burner nozzle 10 is adapted for connection to a petroleum source and an air source (not shown) of a kind known in the art.

Burner nozzle 10 comprises a fluid conduit means 11 for connection to the petroleum source, and the fluid conduit means includes a tube portion 12. Tube portion 12 defines a central opening 14 therethrough and has a first bore 16 and a slightly larger second bore 18 therein. An annular, inwardly facing chamfered surface 20 extends between first and second bores 16 and 18.

Disposed in central opening 14 of tube portion 12 is a burner nozzle insert 22 having a substantially conical nozzle portion or tip 24. At least a portion of nozzle portion 24 has a substantially constant cross-sectional wall thickness. That is, nozzle portion 24 has a substantially conical inner surface 26 and a substantially conical outer surface 28. A longitudinally outer end 30 of nozzle portion 24 of insert 22 faces outwardly from burner nozzle 10.

Insert 22 also includes an inlet or wall portion 32, also referred to as a back plate 32, which extends substantially perpendicular to a longitudinal axis of nozzle portion 24 and tube portion 12. Insert 22 thus extends across central opening 14 in tube portion 12. Inlet portion 32 has substantially parallel inner and outer surfaces 34 and 36, respectively.

In the preferred embodiment, inlet portion 32 and nozzle portion 24 of burner nozzle insert 22 are integrally formed. To minimize wear and erosion, insert 22 is preferably formed of a relatively hard material such as tungsten carbide, ceramic or other erosion resistant material.

Figure 2:
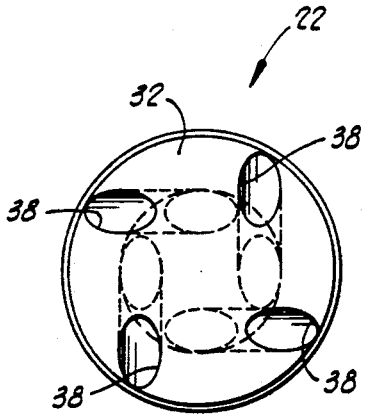
FIG. 2 is an inlet end view of the nozzle insert used in the burner nozzle.

Referring now also to FIG. 2, defined through inlet portion 32 of insert 22 are a plurality of inlet ports 38, also referred to as entrance orifices 38. In the embodiment shown in the drawings, four such inlet ports 38 are provided, but the invention is not intended to be limited to this particular number. Each of inlet ports 38 is preferably positioned off center with regard to insert 22, as best seen in FIG. 2. Also, each of inlet ports 38 is preferably disposed at an acute angle with respect to the longitudinal axis of insert 22 and nozzle portion 24 thereof. In the preferred embodiment, each inlet port 38 has an inlet end at outer surface 36 and an outlet end at inner surface 34 of inlet portion 32. Each of inlet ports 38 angles inwardly from its inlet end to its outlet end such that the outlet end is adjacent to inner surface 26 of nozzle portion 24 near inner surface 34.

Insert 22 has an outside diameter 40 adapted to fit closely within second bore 18 of tube portion 12. An annular, outwardly facing chamfered surface 42 extends between outer surface 36 of inlet portion 32 and outside diameter 40. Chamfered surface 42 is adapted for metal-to-metal, sealing contact with chamfered surface 20 in tube portion 12. An elastomeric sealing means, comprising an elastomeric member such as O-ring 44, provides sealing engagement between outside diameter 40 of insert 22 and second bore 18 of tube portion 12. Thus, a sealing means including both metal-to-metal sealing and elastomeric sealing is provided between insert 22 and tube portion 12.

Insert 22 defines an annular shoulder 46 thereon which faces toward the outlet of nozzle 10. It will be seen that shoulder 46 extends between outer surface 28 of nozzle portion 24 and outside diameter 40.

A nut 48 is connected to tube portion 12 at threaded connection 50 and adapted to bear against shoulder 46 on insert 22 to hold the insert in position, thus providing a fastening means radially outwardly of insert 22. Nut 48 and insert 22 may be said to form part of fluid conduit means 11, along with tube portion 12.

Nut 48 defines a substantially conical inner surface 52 therein which generally faces outer surface 28 of conical portion 24 of insert 22. Inner surface 52 in nut 48 is preferably spaced radially outwardly from outer surface 28 of insert 22 such that a generally annular, conical gap 54 is defined therebetween. This conical gap 54 allows for different thermal expansion of insert 22 and nut 48 and thereby prevents thermal ratcheting that might occur between the two components as a result of such expansion differences.

Figure 3:
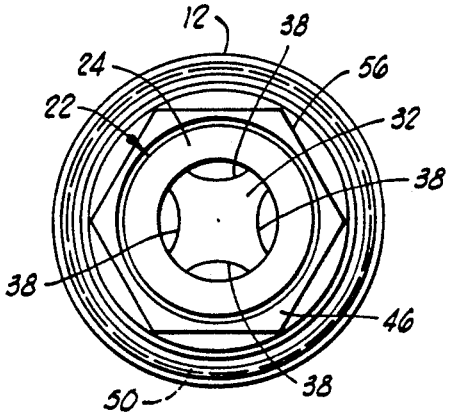
FIG. 3 is an outlet end view taken along lines 3—3 in FIG. 1.

Referring also to FIG. 3, nut 48 has a plurality of wrenching flats 56 thereon so that it may be easily threaded into tube portion 12. A longitudinally outwardly facing end 58 of nut 48 is substantially flush with outer end 30 on insert 22.

Referring again to FIG. 1, an air jacket means 60 is disposed around fluid conduit means 11, and it will be seen that the air jacket means encloses tube portion 12, insert 22 and nut 48. Preferably, air jacket means 60 is concentric with these portions of fluid conduit means 11.

Air jacket means 60 comprises an inner jacket tube 62 and an outer jacket tube 64 spaced radially outwardly from the inner jacket tube. Thus, an air annulus or passageway 66 is defined between inner jacket tube 62 and outer jacket tube 64. Outer jacket tube 64 is adapted for connection to an air supply (not shown) so that an air source is provided to air annulus 66.

Inner jacket tube 62 is spaced radially outwardly from tube portion 12 of fluid conduit means 11. It will thus be seen by those skilled in the art that any fluid leakage from fluid conduit means 11 will not enter air jacket means 60.

An end plate 68 is attached to a longitudinally outer end of outer jacket tube 64 by any means known in the art, such as weld 70. End plate 68 has a tapered inner surface 72 at its longitudinally outer end. End plate 68 is shown as a one-piece item, but may be made from several components connected together such as by welding.

An adapter 74 is attached to a longitudinally outer end of inner jacket tube 62 by any means known in the art such as weld 76. Adapter 74 is shown as one piece, but may be fabricated from several parts attached together such as by welding. Adapter 74 has at its longitudinally outer end a tapered outer surface 78 which generally faces tapered surface 72 in end plate 68. Tapered surfaces 72 and 78 are spaced apart such that an annular, conical air jetting orifice 80 is defined therebetween. Air supplied to air annulus 66 under pressure will be seen to be jetted from burner nozzle 10 through jetting orifice 80, thus providing an air jetting means.

OPERATION OF THE INVENTION

After a fluid supply has been connected to fluid conduit means 11 and an air supply connected to air jacket means 60, fluid is flowed through fluid conduit means 11. That is, the fluid flows through tube portion 12 and into inlet ports 38 in insert 22. As the fluid flows through inlet ports 38, a swirling motion is imparted to the fluid which continues as the fluid flows through nozzle portion 24. The fluid flowing through inlet ports 38 and swirling through nozzle portion 24 is directed away from inner surface 34 of inlet portion 32 of insert 22. Because of the gradual entrance of fluid into nozzle portion 24 of insert 22, resulting from the angled orientation of inlet ports 38, erosion of inner surface 34 of inlet portion 32 and inner surface 26 of nozzle portion 24 is minimized. Also, since the fluid exits inlet ports 38 adjacent to inner surface 26 of nozzle portion 24, the tendency of fluid to cause erosion on inner surface 26 is also minimized. As previously indicated, erosion of insert 22 may be further minimized by selecting the insert from a hard material, such as tungsten carbide, ceramic, or other erosion resistant material.

The swirling fluid exits nozzle portion 24 adjacent to outer end 30 thereof and tends to spread to form a swirling, conical stream of fluid 82.

Air is supplied to air annulus 66 under pressure such that it discharges through air jetting orifice 80. The jetted air forms a near sonic, annular stream of air 84 which impinges fluid stream 82 at a longitudinally spaced location generally indicated by reference numeral 86. Air stream 84 thus agitates and atomizes fluid stream 82 to facilitate the burning of the petroleum as it exits burner nozzle 10.

It can be seen, therefore, that the burner nozzle of the present invention is well adapted to carry out the ends and advantages mentioned as well as those inherent therein. While a preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A petroleum burner nozzle comprising:

a tube portion defining a central opening therein and connectable to a fluid source;

a nozzle insert disposed in said central opening of said tube portion and comprising:

a substantially conical nozzle portion; and a wall portion integrally formed with said nozzle portion and extending substantially perpendicular to a central axis of said tube portion, said wall portion defining a plurality of fluid inlet ports therethrough in communication with said nozzle portion;

fastening means for holding said insert in place, said fastening means being disposed radially outwardly of said insert and being characterized by a nut having a substantially conical inner surface; and sealing means for sealing between said insert and said tube portion.

2. A burner nozzle insert comprising:

a nozzle portion having a longitudinal axis and a substantially conical inner surface cone and substantially constant radial wall thickness; and an inlet portion adjacent to an end of said conical inner surface of said nozzle portion and intergrally formed therewith, said inlet portion defining a plurality of ports therethrough, said ports being disposed at an acute angle with respect to said longitudinal axis.

3. A burner nozzle insert comprising:

a nozzle portion having a substantially conical configuration with substantial constant radial wall thickness and further having an outlet end, said nozzle portion defining a longitudinal axis; and an inlet portion adjacent to said nozzle portion and opposite said outlet end wherein said inlet portion comprises a wall substantially perpendicular to said longitudinal axis adjacent to a substantially conical inner surface of said nozzle portion and defining a plurality of inlet ports therethrough.

4. The insert of claim 3 wherein said ports are angled with respect to said longitudinal axis.

5. The insert of claim 4 wherein said ports have an outlet end adjacent to a substantially conical inner surface of said nozzle portion.

* * * * *